US007762597B2

(12) United States Patent
Marlin

(10) Patent No.: US 7,762,597 B2
(45) Date of Patent: Jul. 27, 2010

(54) SNOW REMOVAL TOOL

(75) Inventor: Carl Marlin, 2104 E. 12th St., Cheyenne, WY (US) 82001

(73) Assignee: Carl Marlin, Cheyenne, WY (US)

( * ) Notice: Subject to any disclaimer, the term of this patent is extended or adjusted under 35 U.S.C. 154(b) by 0 days.

(21) Appl. No.: 12/131,285

(22) Filed: Jun. 2, 2008

(65) Prior Publication Data

US 2009/0051180 A1 Feb. 26, 2009

Related U.S. Application Data

(60) Provisional application No. 60/941,440, filed on Jun. 1, 2007.

(51) Int. Cl.
*E01H 5/02* (2006.01)

(52) U.S. Cl. ..... 294/54.5

(58) Field of Classification Search ..... 294/54.4, 294/49, 54.5, 57; 37/283, 284, 285, 434; D8/10; 254/25, 131; 56/400.01, 400.05, 56/400.06, 400.16

See application file for complete search history.

(56) References Cited

U.S. PATENT DOCUMENTS 1,202,791 A * 10/1916 Brownstein ..... 37/267
2,637,261 A * 5/1953 Wale ..... 56/400.06
3,218,738 A * 11/1965 Bowerman ..... 37/268
3,727,964 A 4/1973 Nordvik
4,865,373 A 9/1989 Hudson
4,901,801 A * 2/1990 Popivalo ..... 172/375
5,142,855 A * 9/1992 Guidarelli ..... 56/400.16
5,522,629 A 6/1996 Loo
5,791,707 A 8/1998 Szakurski
5,845,949 A 12/1998 Vosbikian
6,268,558 B1 7/2001 Kubota

* cited by examiner

*Primary Examiner*—Paul T Chin
(74) *Attorney, Agent, or Firm*—Marsh Fischmann & Breyfogle LLP

(57) ABSTRACT

A manual snow removal tool used for the pushing and pulling of snow. The configuration of the tool allows the user to move snow by pushing the snow using a pushing blade or by pulling the snow using a pulling blade depending on the orientation of the snow removal tool. The snow removal tool may also incorporate fulcrum skids to allow the tool to remove snow more easily from rough surfaces. The fulcrum skids allow the user to raise and lower the scraping edge of the snow plow over the surface being scraped. The fulcrum skids move more easily across rough surfaces than the scraping edge of a regular plow or shovel. The snow removal tool may also have non-abrasive ends attached to the pushing and pulling blades so that it may be used on sensitive surfaces such as the painted finish on an automobile.

20 Claims, 6 Drawing Sheets

SNOW REMOVAL TOOL

CROSS-REFERENCE TO RELATED APPLICATION

This application claims priority and the benefit of the filing date under 35 U.S.C. 119 to U.S. Provisional Application No. 60/941,440, entitled, "SNOW REMOVAL TOOL." filed on Jun. 1, 2007, the contents of which are incorporated herein as if set forth in full.

FIELD

The invention generally relates to a device used for snow removal. More particularly, the invention relates to a hand operated tool for removing snow from the surface of driveways, sidewalks, motor vehicles, etc.

BACKGROUND

Manual snow shovels are a familiar means for removing snow from driveways and walkways. However, shoveling can become cumbersome and physically demanding when the amount of snow to be removed is large. For example, the repetitive scooping and lifting motions associated with shoveling snow can become fatiguing and time consuming. Additionally, the repetitive lifting required during shoveling can cause various injuries or ailments for the user.

Another readily familiar solution to snow removal is using a powered snow removal machine more commonly known as a "snow blower." While snow blowers solve many of the problems associated with removing snow from large areas, several problems still remain. For example, snow blowers present an investment in purchase price, maintenance, and storage space. Additionally, many snow blowers do not work well when removing snow that has a shallow depth.

One possible alternative to manual snow shovels and snow blowers is a manual snow plowing device. These devices allow a user impart a sliding motion on a plow blade when removing snow. One advantage arises as pushing the snow alleviates the need for the repetitive lifting motion associated with shoveling. Additionally, when pushing the snow, many times the weight than can be lifted is removed. An advantage over snow blowers lies in the ability to remove snow associated with lighter snow depths without the cost and burdens associated with operating powered snow blowers.

However, manual snow plow devices available today slide across the surface on their scraping edge. This makes traditional snow plow devices difficult to use on rough surfaces such as asphalt because the scraping edge gets stuck on ridges and bumps on the surface. Furthermore, the scraping edge can become worn down when used on abrasive surfaces, which may affect the performance of traditional manual snow plows. Additionally, traditional manual snow plows are subject to damage at the corners of their scraping edge which may further affect performance.

SUMMARY

It is an object of the present invention to overcome the drawbacks of prior art snow removal devices and to provide for a more practical, useful, and convenient device for use in the removal of snow from driveways, sidewalks, automobiles, etc.

It is another object of the present invention to provide a snow removal tool which allows a user to efficiently push and pull snow from a surface.

It is a further object of the present invention to provide an automotive snow removal tool which provides protection against scratching or marring of the finish of an automobile.

To achieve the objects of the present invention, a snow removal tool is provided that is self-loading and enables a user to remove snow from a surface using both a pushing and pulling motion. The invention includes a blade support member, and a handle attached to the blade support member for holding the tool. Secured to opposite edges of the blade support member are a pulling blade and a pushing blade. The pulling blade is angled relative to the blade support member in a direction toward the handle. The pushing blade is angled relative to the blade support member in a direction that is away from the handle. The angled blades are configured to allow a user to push snow from a surface when the pushing blade is in contact with the surface, or alternatively, to pull snow from a surface when the pulling blade is in contact with the surface. Thus, a single tool can be used to efficiently pull and push snow from a surface.

One embodiment of the present invention incorporates fulcrum skids attached to the edges of the pushing and pulling blades to allow the user to vary the height of the scraping edge over the surface being plowed. Furthermore, these fulcrum skids reduce the wear on the scraping edges of the pushing and pulling blades. In a further arrangement such skids may protect the corners of the scraping edge from damage.

In another embodiment of the present invention, the snow removal tool may be configured for use on the surface of an automobile. In this embodiment, the surface of the blades may be coated with a non-abrasive material, so as to prevent the scratching of the finish of an automobile. Additionally, the snow removal tool may include a folding or telescoping handle so that the tool can be easily stored in an automobile.

In one embodiment of the invention, the entirety of the blade support member, the pushing blade, and the pulling blade may be fabricated from a single piece of sheet metal. This is advantageous as it allows for inexpensive fabrication and can be done easily with readily available tools. The fulcrum skids may also be made of sheet or plate metal and may be affixed (e.g., welded, bolted, etc.) to the pushing and pulling blades. The handle receiver may also be made from the same material so that it may be affixed to the blade support member.

Additional aspects, advantages, and applications of the present invention will be apparent to those skilled in the art upon consideration of the following description and drawings.

DETAILED DESCRIPTION OF THE DRAWINGS

Figure 1:
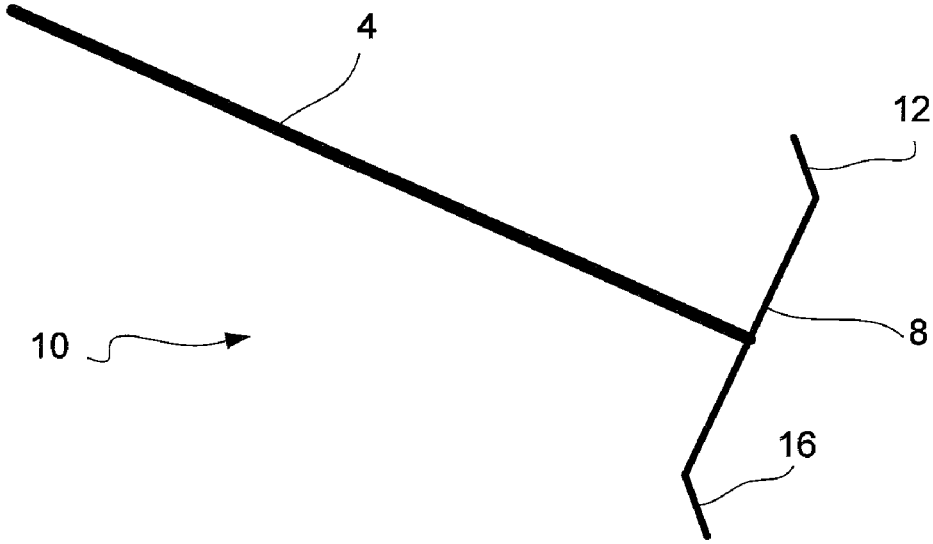
FIG. 1 illustrates a side view of one embodiment of the present invention.

While the invention is susceptible to various modifications and alternative forms, specific embodiments thereof have been shown by way of example in the drawings and are herein described in detail. It should be understood, however, that it is not intended to limit the invention to the particular form disclosed, but rather, the invention is to cover all modifications, equivalents, and alternatives falling within the scope and spirit of the invention as defined by the claims.

A preferred embodiment of a snow removal tool 10 in accordance with the present invention is generally shown in FIG. 1. The snow removal tool 10 includes a blade support member 8, a pushing blade 12, a pulling blade 16, and a handle 4. The elements of the snow removal tool 10 and their interconnection will be described in greater detail below. However, the above named elements are generally related wherein the handle 4 is securely attached to the blade support member 8, which is in turn secured to the pushing blade 12 and the pulling blade 16. The basic mode of operating the snow removal tool 10 generally includes a user imparting a sliding force on the handle 4, which is then translated through the blade support member to either the pushing blade 12 or the pulling blade 16. When the free or scraping edge of the pushing blade 12 is in contact with a surface (e.g. see 28 on FIG. 4), the sliding force will be applied in a direction away from the user, and the pushing blade 12 will correspondingly push a mass of snow off of the surface. When the free or scraping edge of the pulling blade 16 is in contact with the surface, the sliding force will be applied in a direction toward the user, and the pulling blade 16 will pull a mass of snow from the surface.

Figure 2:
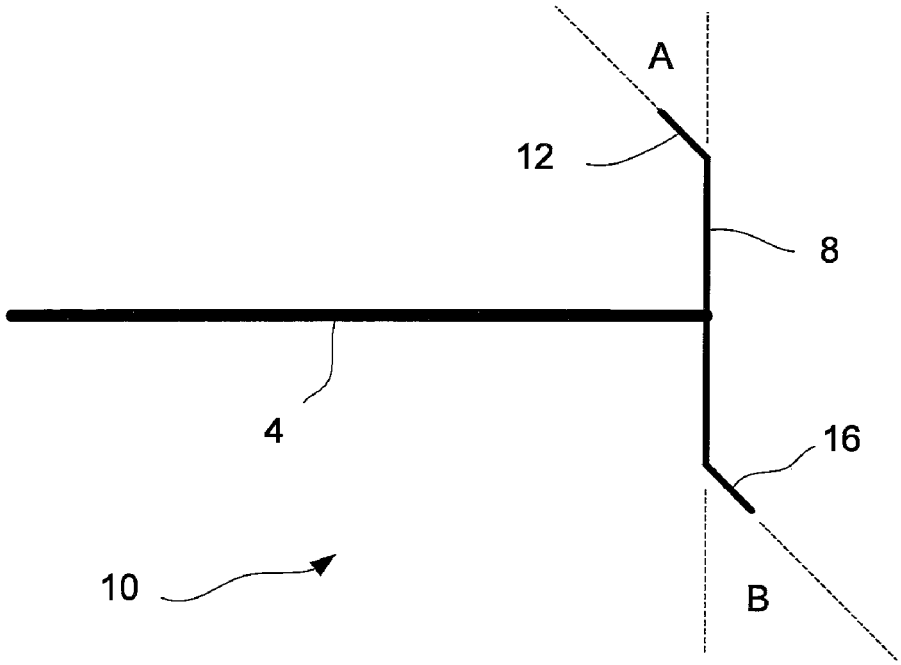
FIG. 2 illustrates the angular offsets of the pushing and pulling blades in accordance with one embodiment of the present invention.

Turning now to FIG. 2, the angular offsets of the pushing blade 12 and the pulling blade 16 are shown. The free or scraping edge of the pushing blade 12 extends from an edge of the blade support member 8. The pushing blade 12 is positioned at a first angle A relative to the plane created by the blade support member 8 and in a direction away from the handle 4. Similarly, the free or scraping edge of the pulling blade 16 extends from an opposite edge of the blade support member 8. The pulling blade 16 is positioned at a second angle B relative to the plane created by the blade support member 8 and in a direction towards the handle 4. Depending on various factors (e.g., intended user, type of snow, length of the handle, etc), angle A and B are between 15 degrees and 75 degrees, and more preferably between 30 degrees and 60 degrees, for example 45 degrees. It will be appreciated that angle A and angle B need not be the same.

Figure 4:
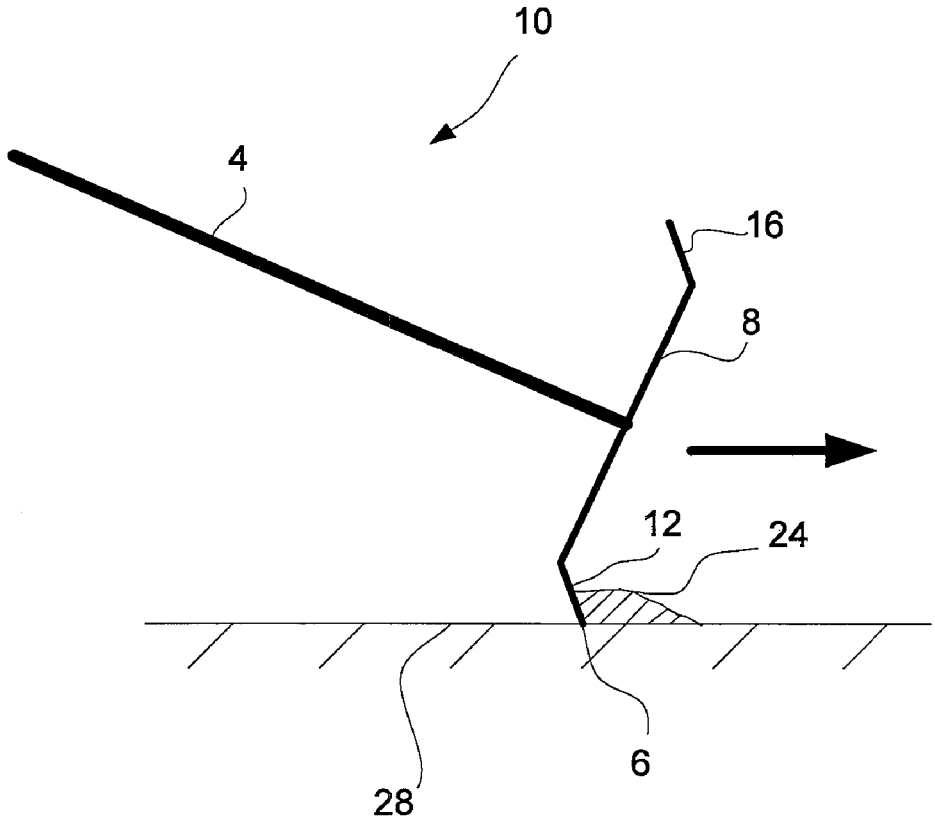
FIG. 4 illustrates the operation of one embodiment of the present invention when configured to remove snow from a surface by using a pushing motion.
Figure 5:
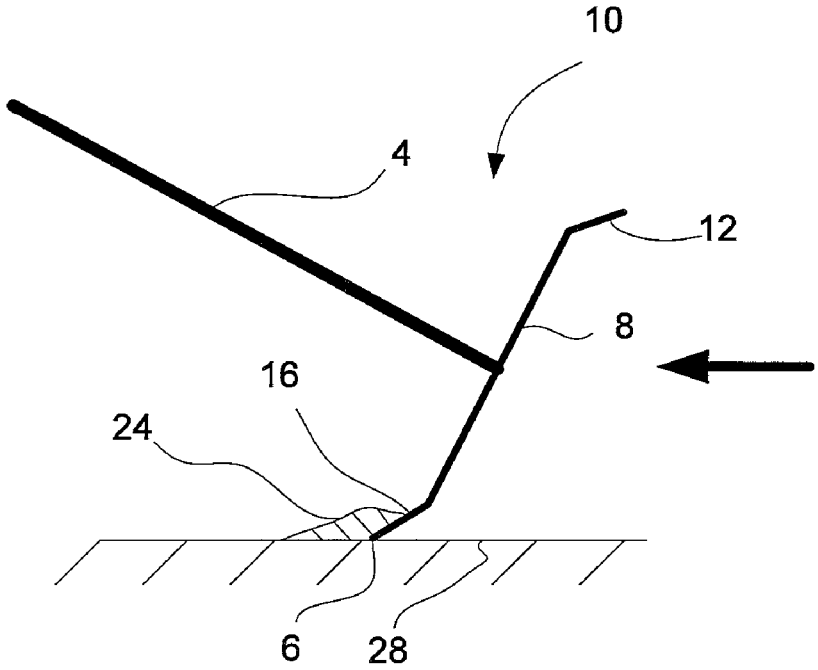
FIG. 5 illustrates the operation of one embodiment of the present invention when configured to remove snow from a surface by using a pulling motion.

FIG. 4 illustrates the snow removal tool 10 oriented so as to push snow 24. The handle 4 is pushed away from the user, so that snow 24 is scraped off of the surface by free or scraping edge 6 and builds up on the face of the pushing blade 12, and the snow is pushed off the surface 28 in the direction indicated by the arrow. The angled position of the pushing blade 12 is such that the weight of the loaded snow 24 against the face of the pushing blade 12 when the snow removal tool 10 is pushed forces the scraping edge of the pushing blade 12 to remain in contact with the surface 28. A user may then rotate the handle 4 180 degrees and place the pulling free or scraping edge 6 in contact with the surface 28 as shown in FIG. 5. In this configuration, the handle 4 is pulled toward the user so that snow 24 is scraped off of the surface by free or scraping edge 6 and builds up on the face of the pulling blade 12, and is thereby pulled off the surface 28 in the direction indicated by the arrow. When the snow 24 is pulled, the angle of the pulling blade 16 is such that the weight of the loaded snow 24 pushes against the face of the pulling blade 16 forcing the scraping edge of the pulling blade 16 to remain in contact with the surface 28. In this manner the tool 10 is self-loading in the sense that the weight of the snow 24 being removed from the surface 28 forces the edge of the pulling blade 16 or pushing blade 12 toward the surface 28.

The pushing blade 12 and pulling blade 16 are typically constructed from strong, preferably corrosion-resistant materials, for example plastic, aluminum, or stainless steel. Alternatively, the blades could be made from carbon steel, which is strong and relatively inexpensive, and which may be coated with a corrosion-resistant material, such as paint or powder coat. Additionally the blades 12, 16 may be composed of the same or different materials than the blade support member 8. Moreover, the blades 12, 16 may be attached to the blade support member 8 by any suitable means (e.g., screws, welding, etc.). Alternatively the blade support member 8 and the blades 12, 16 may be constructed from a single piece of material.

The handle 4 may be attached to the blade support member 8 by any suitable means. Examples of acceptable methods are welding the handle 4 to the blade support member 8 or using a fastener, such as one or more screws. In accordance with another suitable method, the blade support member 8 may include a pipe (see FIG. 7) extending perpendicularly from the blade support member 8 with an inner diameter that is slightly larger than the diameter of the handle 4. The handle 4 is then inserted into the pipe. The handle is prevented from being removed from the pipe by any suitable means. Examples include force fitting the handle 4 into the pipe, threadably engaging the handle 4 into the pipe, or using a suitable fastener.

The handle 4 is preferably made from a strong and lightweight material. Handles 4 are commonly known in the art of hand-held material moving tools and any material that is used in such handles which is strong and lightweight would be acceptable. Examples of such material are wood, fiberglass, plastic, or certain metals, such as aluminum. The length of the handle 4 will be dependant on the specific application and intended user of the snow removal tool. Furthermore, the handle may be of a variety of lengths, and may be telescoping or foldable as well. Thus, this invention is not limited as to the length of the handle 4. The handle 4 is preferably centered laterally on and perpendicular to the blade support member 8, however the invention is not limited in this manner. Advantageously, this configuration provides an efficient transfer of force from the user to the snow that is being removed. Additionally, this configuration minimizes the stress placed on the interface consisting of the handle 4 and the blade support member 8. Finally, the handle 4 may be contoured to provide a secure grip for the user.

Figure 3:
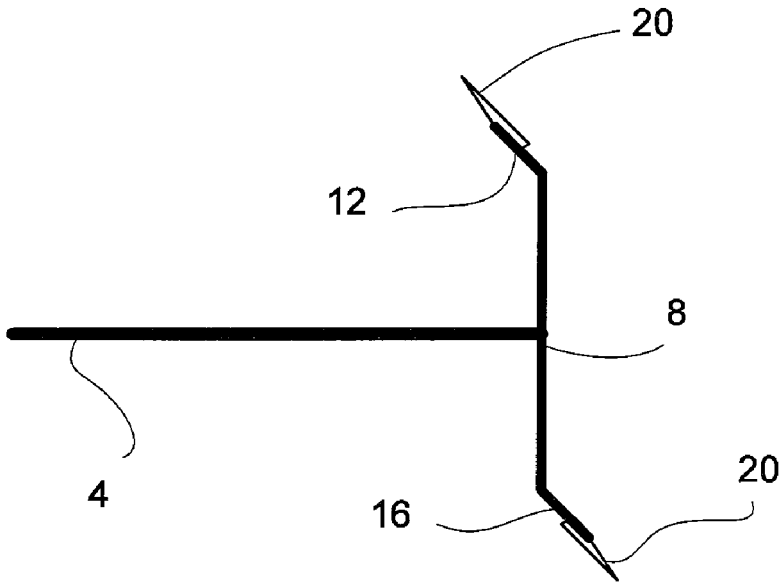
FIG. 3 illustrates a side view of one embodiment of the present invention, showing the non-abrasive ends placed on the blades.

In another embodiment of the present invention, a snow removal tool 10 is provided which can be used to remove snow from surfaces that are susceptible to damage, such as the paint or windshield of an automobile. In this embodiment, the blades 12, 16 may be constructed of a non-abrasive material, as shown in FIG. 3. Alternatively, the blades 12, 16 may be covered or coated with a non-abrasive material. Any material that will not damage the sensitive surface will be suitable. As one example, cellular polyethylene material may be used on the outer surface of blades 12, 16. This material is very light in weight and resistant to the absorption of water. Cellular polyethylene also provides for a softness and flexibility at various temperatures to avoid marring the finish of an automobile. In this embodiment, the overall size of the snow removal tool 10 may configured to allow a user to operate the tool 10 with a single hand. Additionally, the handle 4 of the tool 10 may be telescoping or foldable to allow for the compact storage within an automobile.

Figure 6A:
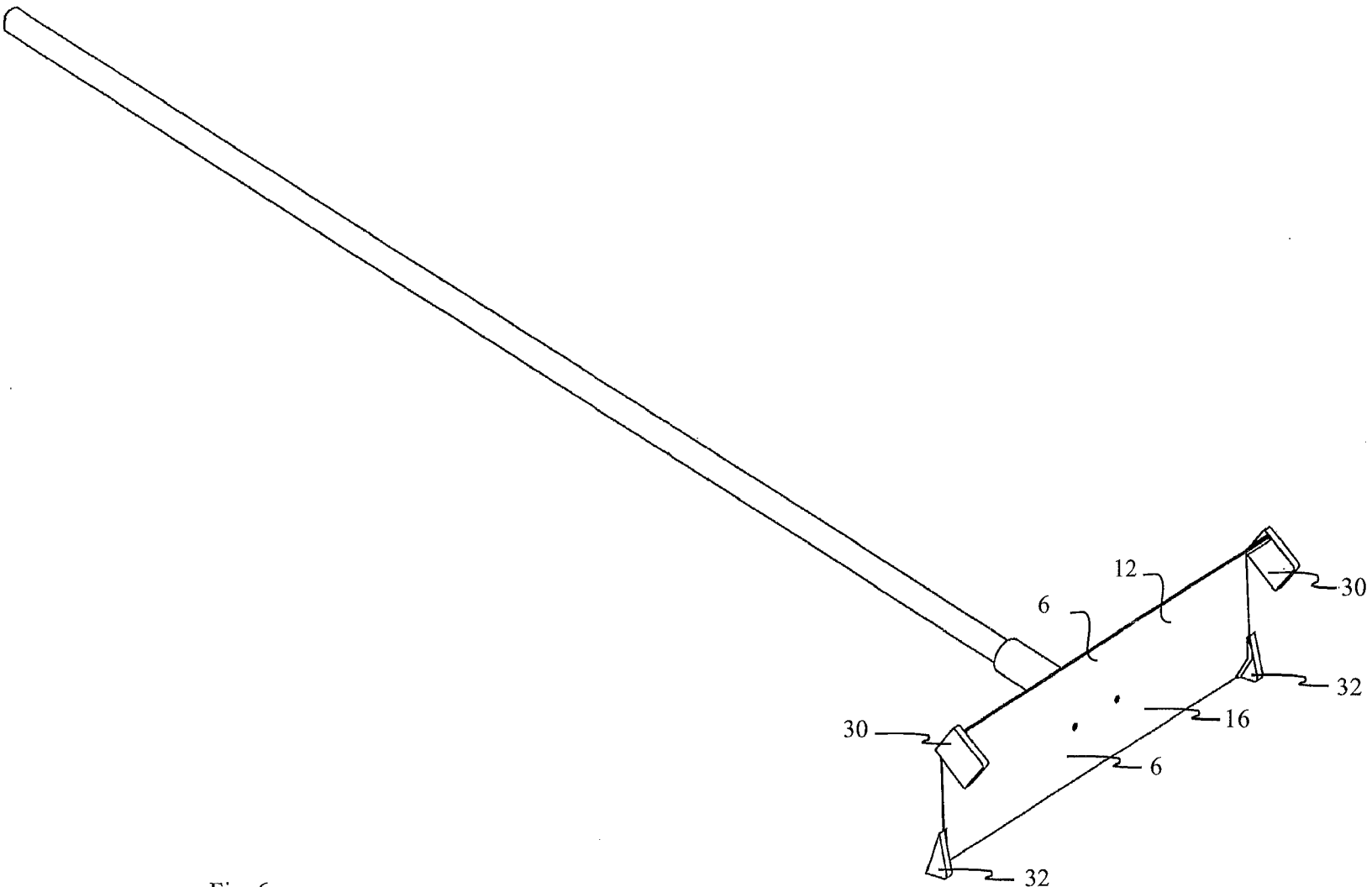
FIG. 6A illustrates one embodiment of the present invention with one embodiment of fulcrum skids attached to the outside edges of the pushing and pulling blades.

In another embodiment of the present invention in FIG. 6A, fulcrum skids 30 and 32 are placed on the outside edges of pushing blade 12 and pulling blade 16. However, it will be noted that in other embodiments such fulcrum skids may be located along the length of pushing blade 12 and pulling blade 16. The fulcrum skids 30, 32 make contact with the surface being plowed and allow the raising and lowering of the scraping edges 6 over the surface being plowed. This makes operation of the plow on rough surfaces easier because there is less contact area when the plow is oriented so that only the fulcrum skids 30, 32 are in contact with the rough surface and the scraping edge 6 is raised slightly above the surface.

Figure 6B:
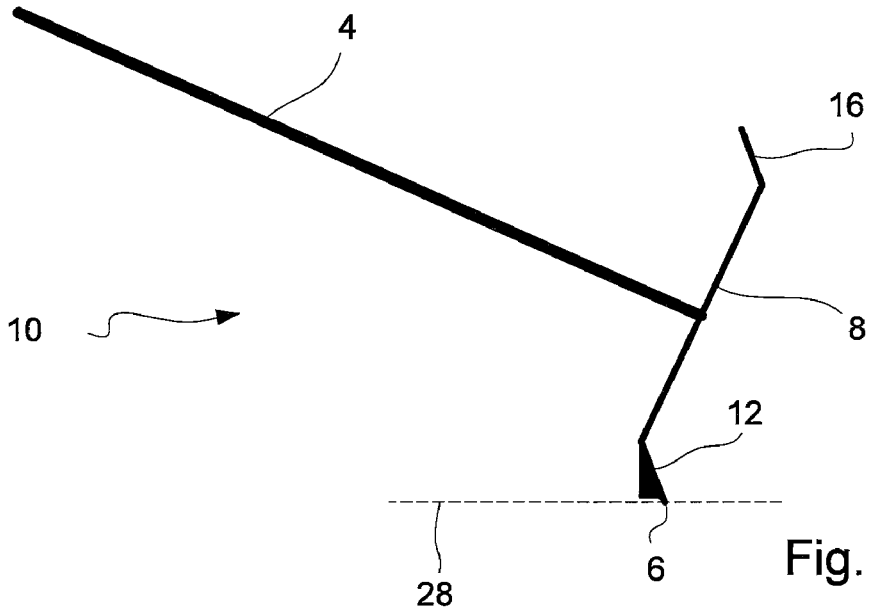
FIGS. 6B and 6C illustrate utilizing a fulcrum skid to raise a scraping edge above a surface.
Figure 6C:
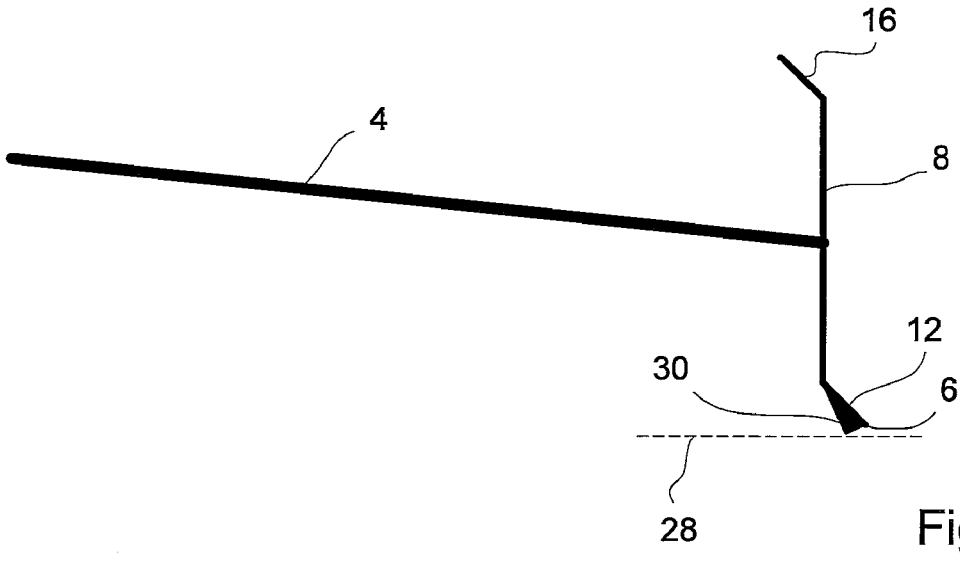

As shown in FIG. 6A, the handle 4 and blade support member are held in a first angular orientation such that the fulcrum skid 30 does not contact the surface 28. In such an orientation, the scraping edge 6 may directly contact the surface for snow removal. In FIG. 6B, the handle 4 is lowered to permit the fulcrum skid to contact the surface and thereby raise the scraping edge 6 off of the surface 28. The fulcrum skids 30, 32 slide easier across the rough surface because their edge is generally parallel to the motion of the plow. Furthermore, when the fulcrum skids 30, 32 are oriented at the ends of pushing and pulling blades 12, 16 they provide the added benefit of protecting the corners of the blades from damage.

The fulcrum skids 30 and 32 are preferably constructed from strong, corrosion-resistant materials, for example plastic, aluminum, or stainless steel. Alternatively, the fulcrum skids could be made from carbon steel, which is strong and relatively inexpensive, and which may be coated with a corrosion-resistant material, such as paint or powder coat. Additionally the fulcrum skids 30, 32 may be composed of the same or different materials than the pushing and pulling blades 12, 16 or the blade support member 8. Moreover, the fulcrum skids 30, 32 may be attached to the pushing and pulling blades 12, 16 by any suitable means (e.g., screws, welding, etc.). Alternatively the blades 12, 16 and the fulcrum skids 30, 32 may be constructed from a single piece of material.

Figure 7:
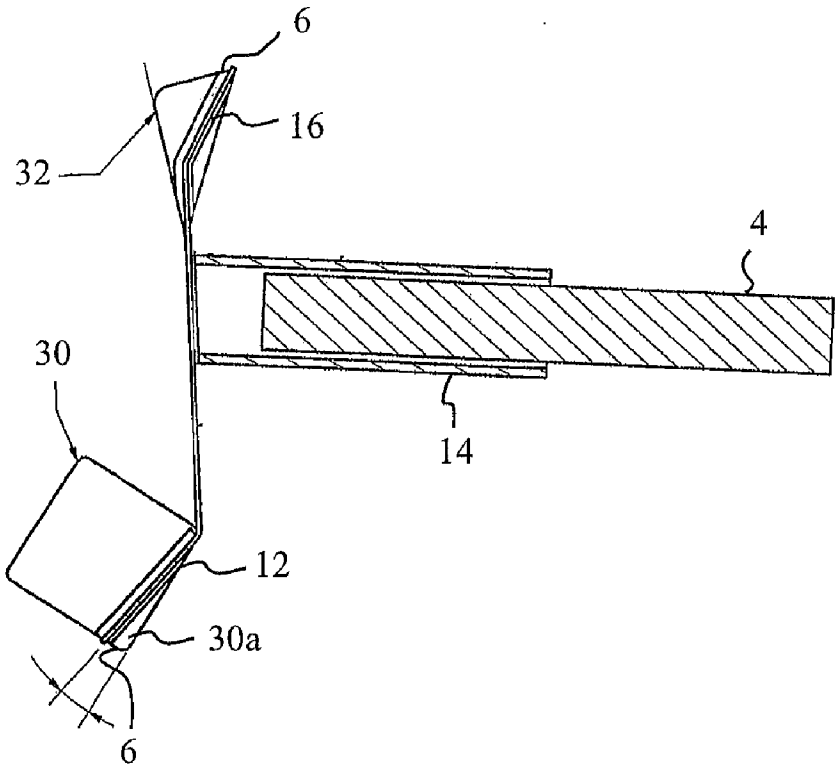
FIG. 7 illustrates one embodiment of the present invention with a handle receiver attached to the blades and one embodiment of the fulcrum skids.

FIG. 7 illustrates one embodiment of the invention with the addition of a handle receiver 14 attached to the blade support member 8. The handle receiver 14 allows the handle 4 to be attached to the blade support member 8. The advantage of this embodiment is that it makes it possible to replace the handle 4 more easily if it is damaged. The orientation of the handle receiver 14 to the blade support member 8 need not be perpendicular and may be angularly displaced from perpendicular. This embodiment makes it easier to use different materials for the handle than for the blade support member. One example of this embodiment would be a wooden handle 4 attached to a steel blade support member 8 through the steel handle receiver 14 welded to the blade support member.

FIG. 7 also illustrates one embodiment of the invention where the fulcrum skid 30 is attached to the outside edge of the pushing blade 12 where a portion 30*a* extends below the scraping edge 6 so that by varying the angle of the handle 4, the fulcrum skid allows the user to vary the height of the scraping edge 6 above the surface being scraped. Fulcrum skid 32 is similarly attached to the pulling blade 16, but on the opposite side so as to perform the same function as fulcrum skid 30 when the snow removal tool is being used to pull snow.

While the invention has been illustrated and described in detail in the drawings and foregoing description, such illustration and description is to be considered as exemplary and not restrictive in character. For example, certain embodiments described hereinabove may be combinable with other described embodiments. Accordingly, it should be understood that only the preferred embodiment and minor variants thereof have been shown and described and that all changes and modifications that come within the spirit of the invention are desired to be protected.

What is claimed is:

1. A snow removal tool comprising:

a blade support member;

a handle supportably attached to a surface of said blade support member;

a pulling blade attached to a first edge of said blade support member with a free edge extending generally toward said handle;

a pushing blade attached to a second edge of said blade support member with a free edge extending generally away from said handle wherein said first and second edges of said blade support member are opposing edges;

at least one planar pushing blade fulcrum skid supportably attached to said pushing blade, wherein said at least one planar pushing blade fulcrum skid extends in a generally perpendicular direction from said pushing blade; and at least one planar pulling blade fulcrum skid supportably attached to said pulling blade, wherein said at least one planar pulling blade fulcrum skid extends in a generally perpendicular direction from said pulling blade, and wherein said at least one planar pushing and pulling blade fulcrum skids allow for selectively raising said free edges of said pushing and pulling blades above a surface when said snow removal tool is being used for pushing or pulling snow, respectively.

2. The snow removal tool of claim 1, wherein said at least one planar pushing blade fulcrum skid supportably attached to said pushing blade further comprises:

first and second fulcrum skids attached to lateral edges of said pushing blade.

3. The snow removal tool of claim 1, wherein said at least one planar pulling blade fulcrum skid supportably attached to said pulling blade further comprises:

first and second fulcrum skids attached to lateral edges of said pulling blade.

4. The snow removal tool of claim 1, wherein each of said at least one planar pushing and pulling blade fulcrum skid comprises:

a plate member having a first portion substantially aligned with a scraping edge of one of said pushing and pulling blades and a second portion extending from said scraping edge.

5. The snow removal tool of claim 4, wherein:

when said blade support member is in a first angular orientation, said first portion of said plate member and said scraping edge contact said surface and when said blade support member is in a second angular orientation, said second portion of said plate member contacts said surface and said scraping edge is elevated above said surface.

6. The snow removal tool of claim 1 wherein:

said blade support member is substantially planar and defines a reference plane.

7. The snow removal tool of claim 6 wherein:

said handle has a free end and a base end supportably attached to said blade support member, wherein a vertical angle between reference axis extending between said free end and said base end and a said reference plane is in a range of negative 10 degrees to positive 10 degrees.

8. The snow removal tool of claim 7, wherein:

the range is between negative five degrees and positive five degrees.

9. The snow removal tool of claim 6 wherein:

said pulling blade is substantially planar defining a pulling blade plane, wherein an included angle between said pulling blade plane and said reference plane is between about 10 degrees and about 80 degrees.

10. The snow removal tool of claim 9, wherein:

said included angle is between about 30 degrees and about 60 degrees.

11. The snow removal tool of claim 6 wherein:

said pushing blade is substantially planar defining a pushing blade plane, wherein an included angle between said pulling blade plane and said reference plane is between about 10 degrees and about 80 degrees.

12. The snow removal tool of claim 11, wherein:

said included angle is between about 30 degrees and about 60 degrees.

13. The snow removal tool of claim 1 further comprising:

a handle receiver supportably attached to said blade support member for receiving said handle there through to supportably attach said handle to said blade support member.

14. A snow removal tool comprising:

a blade support member that generally resides in a first plane, said blade support member comprising opposing first and second edges and opposing front and back surfaces;

a handle supportably attached to said front surface of said blade support member;

a pulling blade attached to said first edge of said blade support member, said pulling blade generally residing in a second plane and including a free edge that extends generally from and away from said front surface;

a pushing blade attached to said second edge of said blade support member, said pushing blade generally residing in a third plane and including a free edge that extends generally from and away from said back surface;

a non-abrasive blade supportably attached to said pulling blade so that a free edge of said non-abrasive blade extends beyond said free edge of said pulling blade; and a non-abrasive blade supportable attached to said pushing blade so that a free edge of said non-abrasive blade extends beyond said free edge of said pushing blade.

15. The snow removal tool of claim 14 wherein:

an included angle between said second plane and said first plane is between about 30 degrees and about 60 degrees.

16. The snow removal tool of claim 14 wherein:

an included angle between said third plane and said first plane is between about 30 degrees and about 60 degrees.

17. A method of constructing a snow removal tool comprising:

providing a generally rectangular piece of sheet metal, said sheet metal residing in a first plane and comprising opposing first and second ends, opposing first and second ends, and opposing front and back faces;

bending a first angle in said sheet metal near said first side to create a first bent portion, said first bent portion residing in a second plane and extending from and away from said front face;

bending a second angle in said sheet metal near said second side to create a second bent portion, said second bent portion residing in a third plane and extending from and away from said back face; and attaching a handle to said front face.

18. A method of constructing a snow removal tool of claim 17 further comprising:

attaching a first planar fulcrum skid to a first edge of said first bent portion in a direction transverse to said first side; and attaching a second planar fulcrum skid to a second edge of said first bent portion opposite from said first planar fulcrum skid.

19. A method of constructing a snow removal tool of claim 18 further comprising:

attaching a third fulcrum skid to a first edge of said second bent portion in a direction transverse to said second side; and, attaching a fourth fulcrum skid to a second edge of said second bent portion opposite from said third fulcrum skid.

20. A method of constructing a snow removal tool of claim 14, wherein said second plane is parallel to said third plane.

* * * * *